US008292475B2

(12) United States Patent
D'Alelio

(10) Patent No.: US 8,292,475 B2
(45) Date of Patent: Oct. 23, 2012

(54) METHOD FOR ENHANCING THE FRICTIONAL GRIP OF A CLIP-ON LAMPSHADE

(76) Inventor: John R. D'Alelio, Braintree, MA (US)

( * ) Notice: Subject to any disclaimer, the term of this patent is extended or adjusted under 35 U.S.C. 154(b) by 197 days.

(21) Appl. No.: 12/694,172

(22) Filed: Jan. 26, 2010

(65) Prior Publication Data

US 2011/0051439 A1 Mar. 3, 2011

Related U.S. Application Data

(60) Provisional application No. 61/238,703, filed on Sep. 1, 2009.

(51) Int. Cl.
*F21V 11/00* (2006.01)

(52) U.S. Cl. ..... 362/351; 362/444

(58) Field of Classification Search ..... 362/351, 362/444, 396

See application file for complete search history.

(56) References Cited

U.S. PATENT DOCUMENTS

| | | | |
|---|---|---|---|
| 2,703,359 | A | 3/1955 | Miller |
| 3,070,690 | A | 12/1962 | August |
| 3,681,593 | A | 8/1972 | Genovese et al. |
| 3,749,346 | A | 7/1973 | Cherniak |
| 3,953,761 | A | 4/1976 | Giudice |
| 4,088,293 | A | 5/1978 | Delmore |
| 4,230,297 | A | 10/1980 | Comer et al. |
| 4,241,386 | A | 12/1980 | Dooley |
| 4,270,071 | A | 5/1981 | Morton |
| 4,428,032 | A | 1/1984 | Workman |
| 4,498,125 | A | 2/1985 | Schumaker |
| 4,538,090 | A | 8/1985 | Wilhelm et al. |
| 4,644,224 | A | 2/1987 | Saita et al. |
| 4,714,987 | A | 12/1987 | Dene |
| 4,739,222 | A | 4/1988 | Nomoto et al. |
| 4,827,382 | A | 5/1989 | Feliks |

(Continued)

FOREIGN PATENT DOCUMENTS

| | | |
|---|---|---|
| CA | 2451903 | 6/2005 |

(Continued)

OTHER PUBLICATIONS http://www.elightbulbs.com/catalog_product.cfm?source=ShoppingCSE&prod=QQ00401 Downloaded Apr. 7, 2009 Adjustable Clip will Support FT55DL/841 Fluorescent Light Bulb.

(Continued)

*Primary Examiner* — Evan Dzierzynski

(74) *Attorney, Agent, or Firm* — Jerry K. Joseph; Law Office of Jerry Joseph, PLC

(57) ABSTRACT

A method is disclosed for enhancing secureness of grip of a light-bulb-clip of a clip-on lampshade, by enhancing the frictional properties of the light-bulb-clip. Also disclosed are a clip-on lampshade, and a finial clip-on lampshade adapter, which both include a light-bulb-clip that is formed using the disclosed method. Frictional gripping capability is increased by optionally abrading, and applying and curing a liquid coating of polymer dipping compound to, portions of wire that are to function as gripping portions of a light-bulb-clip, thereby forming a cured, friction-enhancing layer that enables the light bulb clip to be more securely attached to either a traditional light bulb or to a compact fluorescent "CFL" bulb. The liquid coating can be applied by dipping, brushing, and/or spraying. Curing can be by heating and/or allowing to dry. The dipping compound is ideally made from heat-resistant elastomer and/or silicone.

21 Claims, 11 Drawing Sheets

U.S. PATENT DOCUMENTS

| | | | |
|---|---|---|---|
| 4,979,084 | A | 12/1990 | Krauthamer |
| 5,045,981 | A | 9/1991 | Nagano |
| 5,088,670 | A | 2/1992 | Taylor |
| 5,184,890 | A | 2/1993 | Chen et al. |
| 5,546,291 | A | 8/1996 | Simes |
| 5,613,772 | A | 3/1997 | Sawyer |
| 5,758,850 | A | 6/1998 | Yousefzadeh |
| 5,857,652 | A | 1/1999 | Yousefzadeh |
| 5,864,461 | A | 1/1999 | Cho |
| 5,961,204 | A | 10/1999 | Martich et al. |
| 5,980,068 | A | 11/1999 | Yu |
| 6,068,229 | A | 5/2000 | Wang |
| 6,224,226 | B1 | 5/2001 | Bucher et al. |
| 6,264,349 | B1 | 7/2001 | Morter |
| 6,296,375 | B1 | 10/2001 | Sung et al. |
| 6,375,339 | B2 | 4/2002 | Maruyama et al. |
| 6,582,253 | B1 | 6/2003 | Lau |
| 6,692,308 | B2 | 2/2004 | Henrici et al. |
| 6,796,688 | B2 | 9/2004 | Huang |
| 6,981,785 | B1 | 1/2006 | Watchulonis |
| 7,018,074 | B2 | 3/2006 | Raby et al. |
| 7,033,049 | B2 | 4/2006 | Lin |
| 7,268,494 | B2 | 9/2007 | Yasuda et al. |
| 7,434,961 | B1 | 10/2008 | Bernhardt |
| 2004/0201996 | A1 | 10/2004 | Weber |
| 2007/0177390 | A1 | 8/2007 | Evans |
| 2008/0278056 | A1 | 11/2008 | Lukacs |

FOREIGN PATENT DOCUMENTS

| | | | |
|---|---|---|---|
| CA | 2458252 | C | 2/2008 |
| CN | 11145493 | A | 3/2008 |
| DE | 19615019 | A1 | 10/1997 |
| EP | 0677698 | A1 | 10/1995 |
| EP | 0677702 | A1 | 10/1995 |
| EP | 0624754 | A1 | 8/1997 |
| EP | 0624754 | B1 | 8/1997 |
| EP | 1239555 | B1 | 10/2008 |
| GB | 2407864 | A1 | 5/2005 |

OTHER PUBLICATIONS http://www.lampsplus.com/products/Burgundy-Clip-On-Ceiling-Light-Lamp-Shade_09934.html Downloaded Apr. 7, 2009 Burgundy Clip-On Ceiling Light Lamp Shade.

http://www.cflbulbworld.com/clip-on-ceiling-compact-fluorescent-bulb-lamp-shade.html Downloaded Apr. 7, 2009 clip-on ceiling compact fluorescent bulb lamp shade.

METHOD FOR ENHANCING THE FRICTIONAL GRIP OF A CLIP-ON LAMPSHADE

CROSS-REFERENCE TO RELATED APPLICATIONS

This application claims priority to U.S. Provisional Patent Application 61/238,703 having a filing date of Sep. 1, 2009, and entitled "Method for Enhancing the Frictional Gripping Strength of a Clip-On Lampshade", which is incorporated herein by reference in its entirety. This application also claims priority to U.S. patent application Ser. No. 12/490,289 having a filing date of Jun. 23, 2009, and entitled "Clip-On Lampshade Adaptor for Enhanced Gripping of Both Standard Incandescent and Compact Fluorescent Light Bulbs", which is also incorporated herein by reference in its entirety.

FIELD

The invention generally relates to lampshades, and more specifically to clip-on lampshades.

BACKGROUND

One popular mechanism for attaching a lampshade to a lamp is to use a light-bulb clip that clips directly to the light bulb of the lamp. Typically, a light-bulb-clip is formed by a pair of heavy wire loops that are permanently attached to the lampshade and are able to extend around a light bulb on opposing sides and press toward each other, trapping the light bulb in-between. This approach is used to support lampshades with a variety of weights and sizes, as well as lampshades that include decorative materials such as glass or ceramic, and/or decorative shaping such as pleated cloth. However, for many large and/or heavy lampshades, if the light-bulb-clip does not grip the light bulb with sufficient friction, the size and/or weight of the lampshade can cause it to tip out of alignment, for example when the lampshade is accidentally bumped, or when a table on which the lamp is standing is accidentally bumped.

Most large and heavy lampshades are so-called "finial" lampshades, in that they do not attach to a light bulb, but are supported instead by a separate harp-frame structure that is directly attached to the lamp. Sometimes, it is desirable to use a so-called "finial" lampshade with a lamp that is intended for use with a clip-on lampshade. In such cases, the finial lampshade can be adapted for clip-on use by a so-called finial clip-on lampshade adaptor, which includes a light-bulb-clip at one end and a finial attachment mount at the other end. However, if the finial lampshade is too large and/or too heavy, lack of sufficient frictional grip of the light-bulb clip of the finial clip-on lampshade adaptor can prevent the successful adaptation of the finial lampshade for clip-on use.

So as to improve the energy efficiency of lamps, and thereby reduce cost and minimize impact on the environment, it is often desirable to replace conventional incandescent light bulbs in lamps with so-called compact fluorescent light (CFL) bulbs that are approximately the same size as conventional incandescent light bulbs but last significantly longer than traditional incandescent bulbs while consuming less energy, and can therefore be directly substituted for conventional bulbs. However, while the general size of a replacement fluorescent light bulb is usually similar to a conventional light bulb, the shape of a replacement fluorescent bulb is typically quite different.

A conventional light bulb typically has a rounded, pear-shape, while the most common CFL bulbs typically consist of long, gas-filled tubes that have been coiled into a spiral shape. For this reason, a light-bulb-clip that is configured for firm attachment to a conventional light bulb will often not attach to a replacement fluorescent light bulb securely enough to maintain the lampshade in position, and may consequently allow the lampshade to tip and/or fall off, possibly damaging the lampshade and/or the lamp.

SUMMARY

A method for enhancing the secureness of grip of a clip-on lampshade by enhancing its frictional properties is claimed, as well as a clip-on lampshade and finial clip-on lampshade adaptor to which the method has been applied. The method of the present invention increases the frictional grip of a conventional light-bulb-clip, thereby allowing a clip-on lampshade or a finial clip-on lampshade adaptor to be attached more securely to a traditional pear-shaped incandescent bulb, and allowing most clip-on lampshades and finial lampshades with finial clip-on lampshade adaptors to be attached to a coiled, spiral-shaped CFL bulb with sufficient friction to hold the lampshade firmly in place.

The method uses a coating compound made from an elastic material to coat the portions of wire that are to function as the gripping portions of the light-bulb-clip. First, the portions of wire that are to function as the gripping portions of the light-bulb-clip are preferably abraded to provide bonding. Preferably, the portions of wire that are to function as gripping portions of the light-bulb-clip are first formed into wire ring gripping portions of a light-bulb-clip, which are then are dipped into the dipping compound, or in other preferred embodiments the compound can be applied with a brush, sprayed on, or applied by any other means known in the art. Alternatively, portions of wire that are to function as the wire ring gripping portions can be dipped, brushed or sprayed, or applied by any other means known in the art, even before they have been fashioned into ring-shaped gripping portions. Once the compound is applied and allowed to dry, the resultant polymer coating provides increased static friction between the light-bulb-clip and any light bulb, such as a standard bulb or a replacement fluorescent "CFL" bulb.

In some preferred embodiments, the compound is made from heat-resistant polymers. In some exemplary embodiments the compound is made from heat-resistant elastomeric materials. For example, the compound can be a PVC, latex, silicone, heat resistant rubber (and its derivative materials), heat resistant engineering polymers, polyalkylene-terephthalate, isophthalate, and/or copolyesters; and any other means known in the art. Of these various polymers, silicone dipping compound presently offers the best option because of its thermal stability over a wide temperature range.

BRIEF DESCRIPTION OF THE DRAWINGS

The invention will be more fully understood by reference to the detailed description, in conjunction with the following figures, wherein.

DETAILED DESCRIPTION

Figure 1:
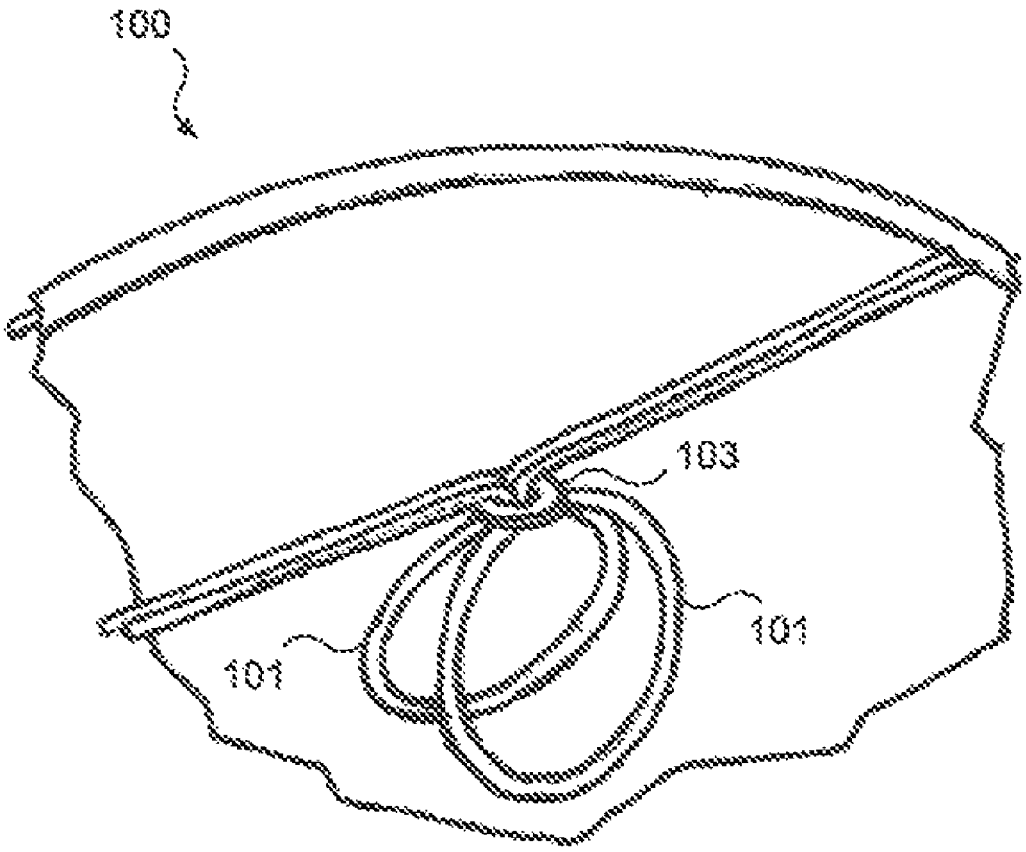
FIG 1 (Prior Art)
FIG. 1 is a perspective view of a conventional clip-on lampshade of the prior art that is supportable by attachment of a wire loop light-bulb-clip to a conventional light bulb.

With reference to FIG. 1, a typical clip-on lampshade 100 includes a pair of wire loops 101 made of metal that extend around each side of a light bulb and press toward each other, trapping the light bulb in between and frictionally gripping the light bulb 103. The frictional grip of the light-bulb-clip formed by the wire loops 101 is directly dependent on the area of contact between the wire loops and the light bulb. In particular, the rounded, pear-like shape of a conventional, incandescent light bulb provides for continuous contact with the wire loops over nearly the entire lengths of the wire loops.

Figure 2B:
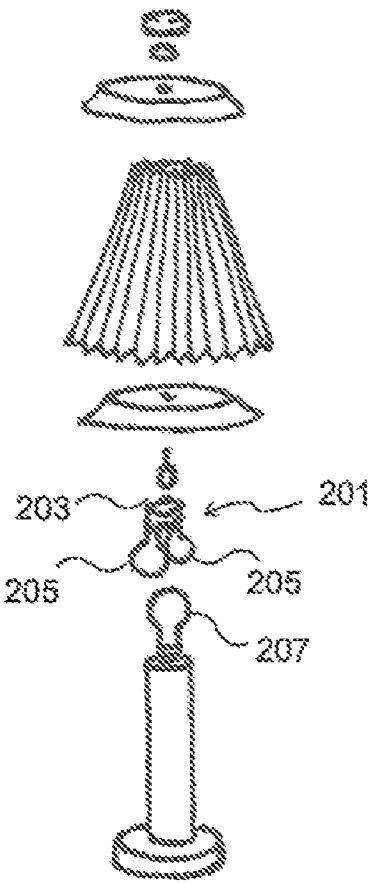
FIG 2B (Prior Art)
FIG. 2B is an exploded view of the finial clip-on lampshade adaptor of FIG. 2A.
Figure 2A:
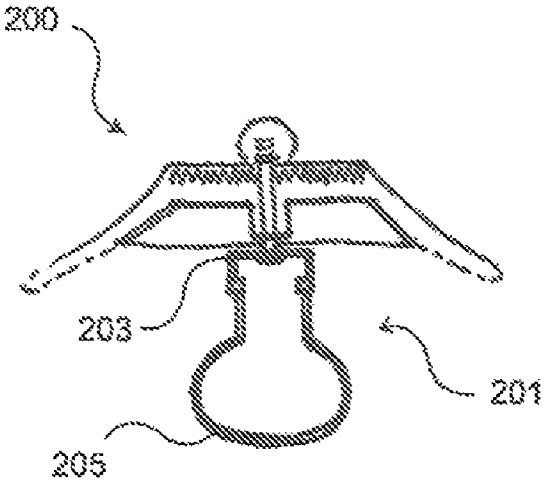
FIG 2A (Prior Art)
FIG. 2A is a perspective view of a "finial" clip-on lampshade adaptor of the prior art that can be used to convert lampshades into clip-on lampshades.

FIG. 2A illustrates a finial lampshade 200 that is designed to be attached to a lamp by a harp-frame (not shown) that is directly attached to the lamp. However, in FIG. 2A a finial clip-on lampshade adaptor 201 has been used to adapt the finial lampshade 200 for clip-on attachment to a light bulb 207. The finial clip-on lampshade adaptor 201 includes a finial attachment at one end 203 and light-bulb clip 205 at the other end. This approach allows a lampshade that was not originally designed for clip-on use to be used with a lamp that is intended for use with a clip-on lampshade. However, if the finial clip-on lampshade adaptor 201 does not provide sufficient grip, adaptation of the finial lampshade for clip-on use will not succeed. FIG. 2B is an exploded view of the lampshade 200 and finial clip-on lampshade adaptor 201 of FIG. 2A.

Figure 3B:
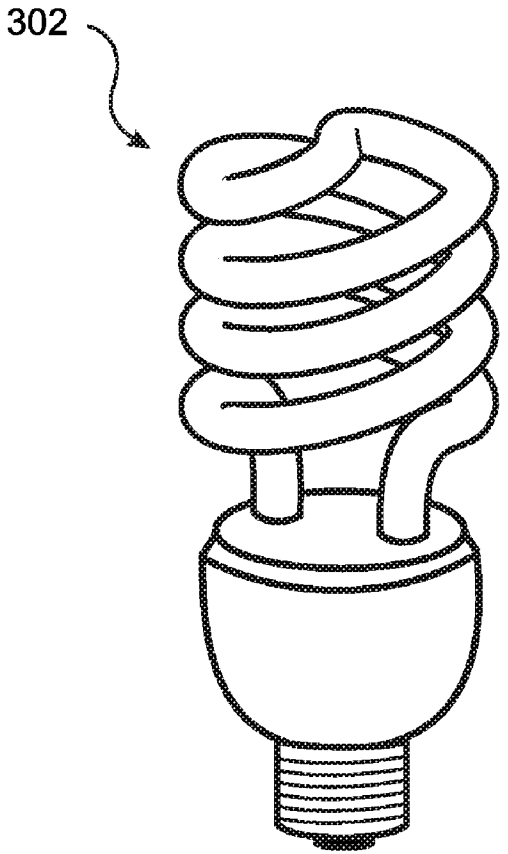
FIG. 3B is a perspective view of a commonly used compact fluorescent light (CFL) bulb.
Figure 3A:
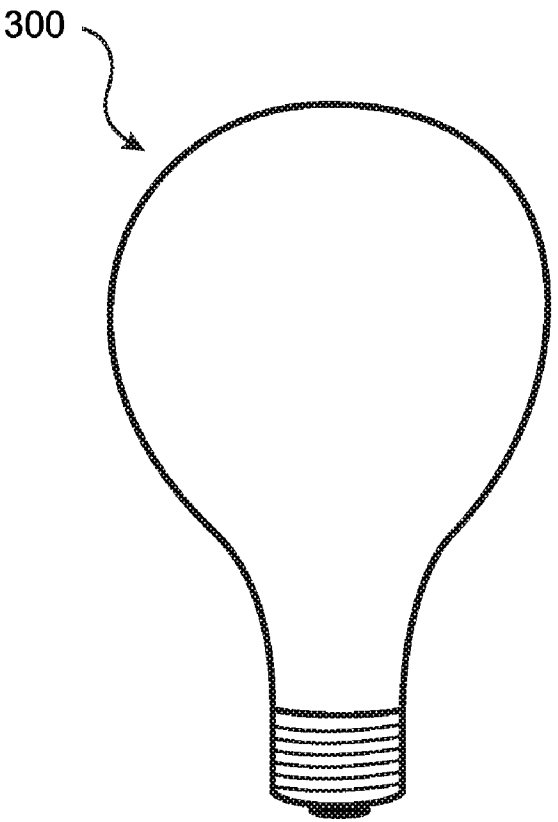
FIG. 3A is a perspective view of a standard incandescent light bulb.

The light bulb clips shown in FIG. 1, FIG. 1A and FIG. 2B provide sufficient friction grip to securely support many lampshades when attached to a conventional, pear-shaped incandescent light bulb, such as the one illustrated in FIG. 3A. Due to both ecological and economic concerns, however, it is often desirable to replace a conventional incandescent light bulb such as the one shown in FIG. 3A with an energy-efficient, compact, fluorescent light (CFL) bulb such as the one shown in FIG. 3B. Although approximately the same size as a conventional incandescent light bulb, a CFL bulb has a shape that is markedly different from a conventional incandescent light bulb. Typically, a CFL bulb is a long, gas-filled tube that has been coiled into a spiral shape. When an attempt is made to attach a conventional light-bulb-clip to a CFL bulb such as the one illustrated in FIG. 3B, only a fraction of the light-bulb-clip's wire loops makes contact with the CFL bulb, thereby significantly reducing the frictional grip of the light-bulb-clip, and potentially allowing the lampshade to fall out of position, possibly falling off and/or causing the lamp to fall over.

While it is possible to use a compact fluorescent light (CFL) bulb with a surrounding, translucent, pear-shaped shell, and thereby provide compatibility with clip-on lampshades, such light bulbs are significantly more expensive than coiled spiral CFL bulbs.

Figure 4A:
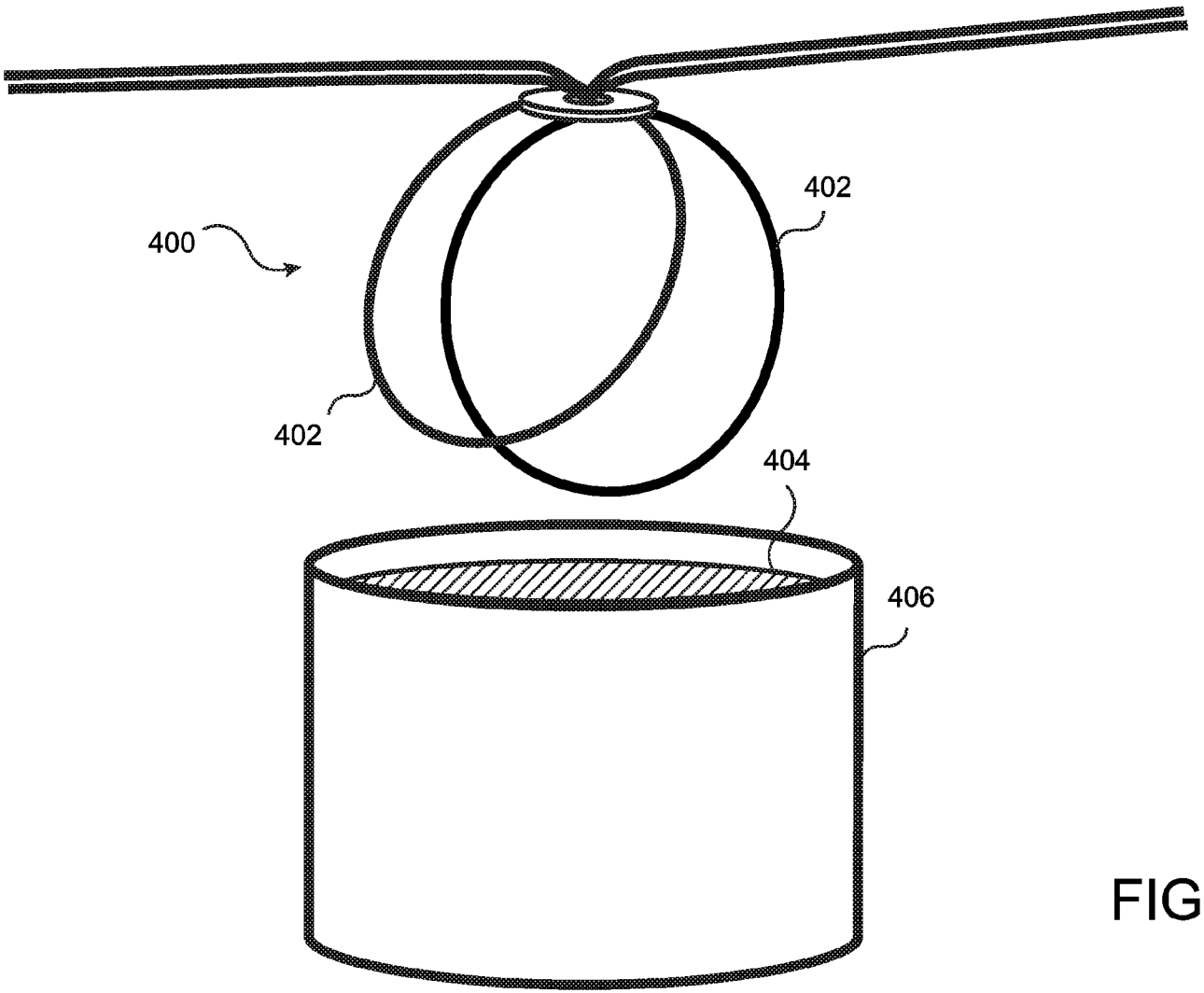
FIG. 4A is a close-up perspective view of the light-bulb-clip of FIG. 2 shown in relationship to a container of dipping compound.

With reference to FIG. 4A, the present invention is a method for enhancing the frictional gripping strength of a light-bulb-clip 400, as well as a lampshade and finial clip-on lampshade adaptor to which the method has been applied. So as to enhance the frictional gripping strength of the light-bulb-clip 400, the wire loops 402 of the light-bulb-clip are coated with a heat-resistant polymer 404, such as a heat-resistant elastomeric dipping compound and/or a silicone dipping compound. For example, the compound can be any heat-resistant thermoplastic, thermostat, engineered polymer, elastomer, or silicone. The dipping compound 404 can be applied to the wire loops 402 by any application method known in the art, such as by spraying or brushing. In alternative embodiments, portions of wire that will function as the gripping portions of a light-bulb-clip are coated, even before the wire portions have been shaped into wire loops. In preferred embodiments, the portions of the wire that are to function as the gripping portions are abraded before the coating is applied.

Figure 4B:
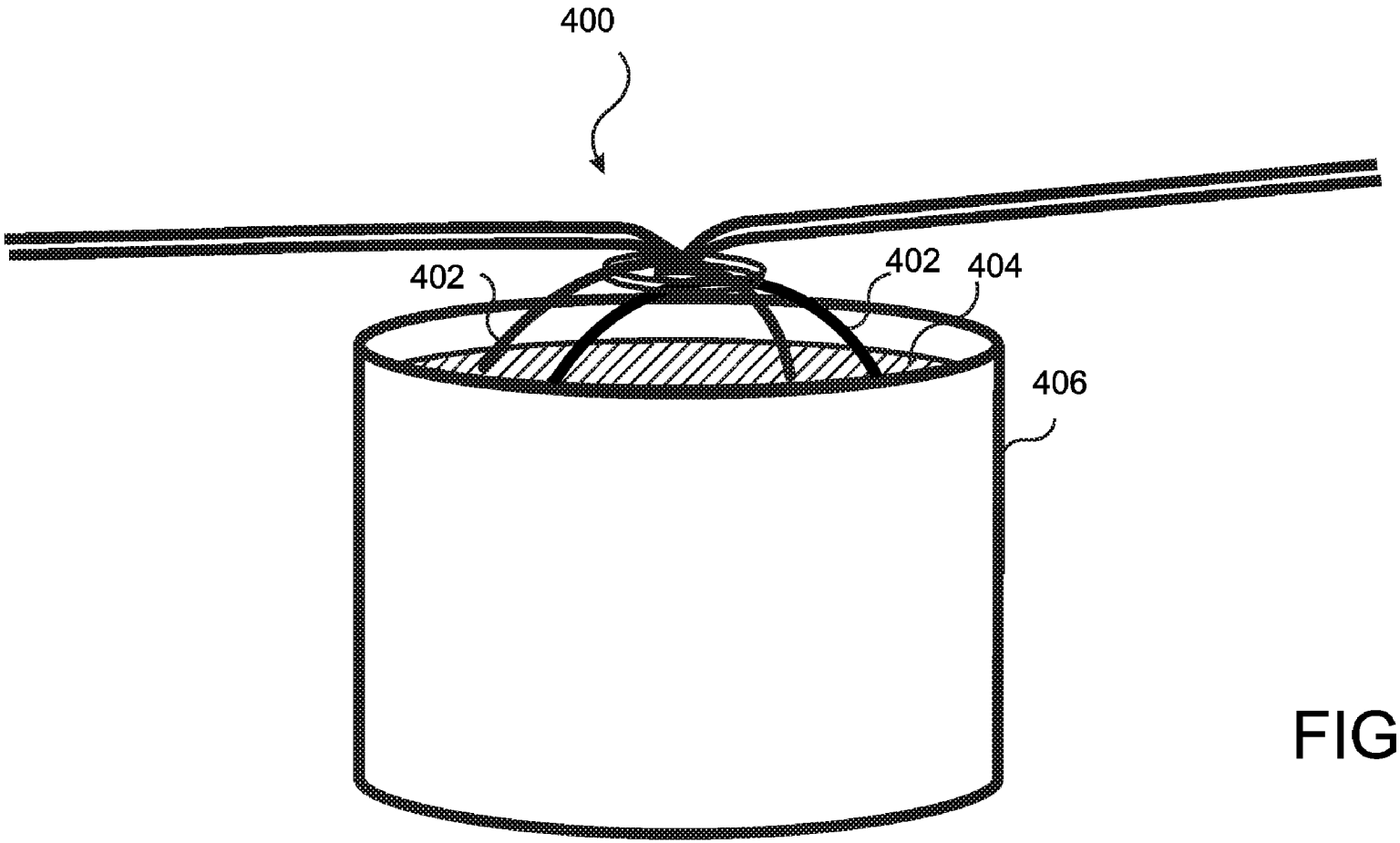
FIG. 4B is a close-up perspective view of the light-bulb-clip of FIG. 4A shown immersed in the container of dipping compound.
Figure 4C:
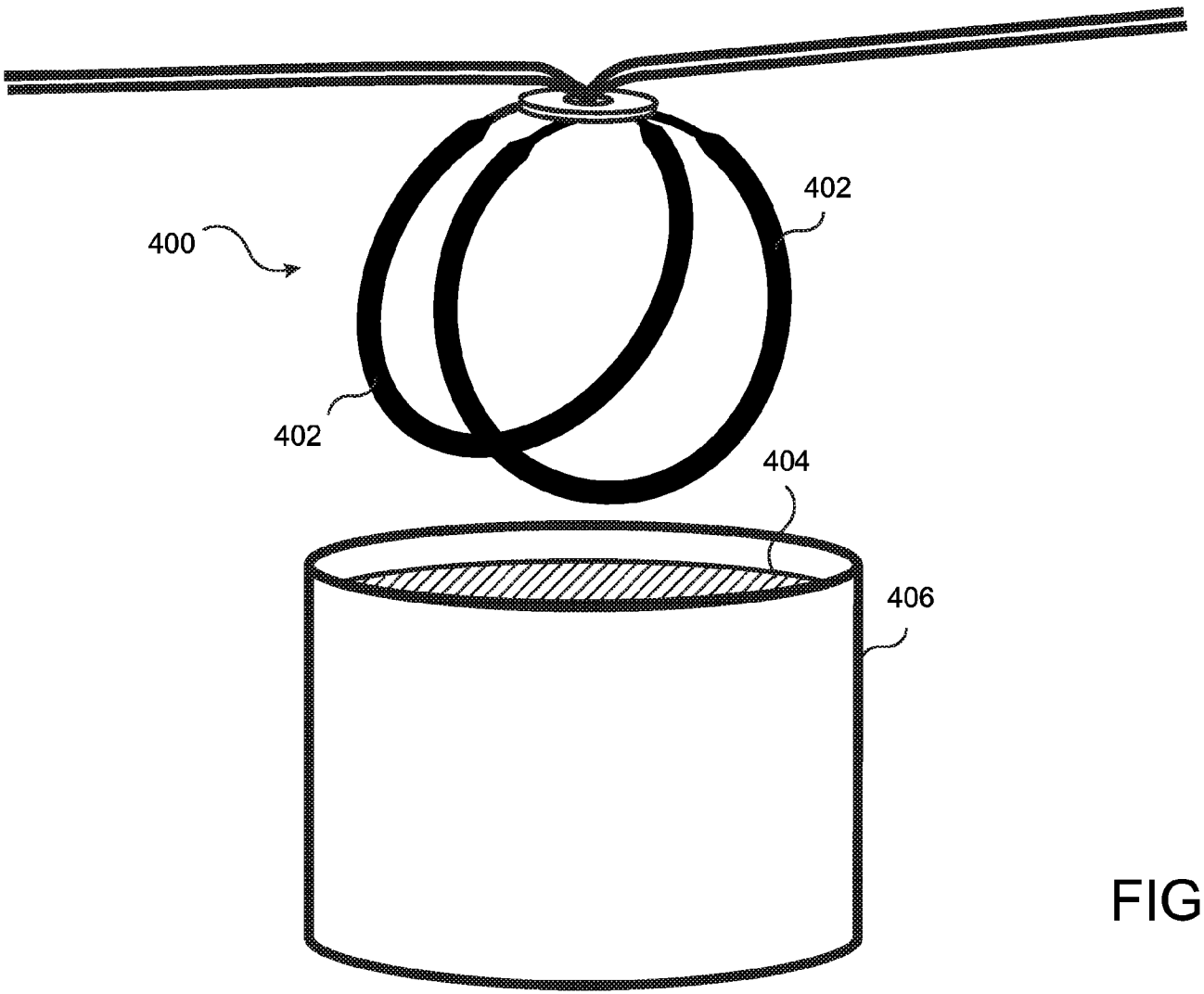
FIG. 4C is a close-up perspective view of the light-bulb-clip of FIG. 4B shown after dipping in the container of dipping compound, with a coat of heat-resistant polymer material applied to the wire loops of the light-bulb-clip.

FIG. 4A through FIG. 4C illustrate a preferred method of application in which the wire loops 402 are dipped into a container 406 that is filled with the dipping compound 404. FIG. 4A shows the light-bulb-clip 400 positioned above the container 406 and prepared for dipping, FIG. 4B shows the configuration after the light-bulb-clip 400 has been lowered, with the wire loops 402 of the light-bulb-clip 400 immersed in the dipping compound 406, and FIG. 4C shows the result of dipping, with the gripping portions of the wire loops 402 of the light-bulb-clip 400 now coated with a thick coating of the polymer compound 404.

FIG. 4A through FIG. 4C illustrate a preferred method of application in which the wire loops are sprayed by a hose that is filled with the compound.

Figure 5A:
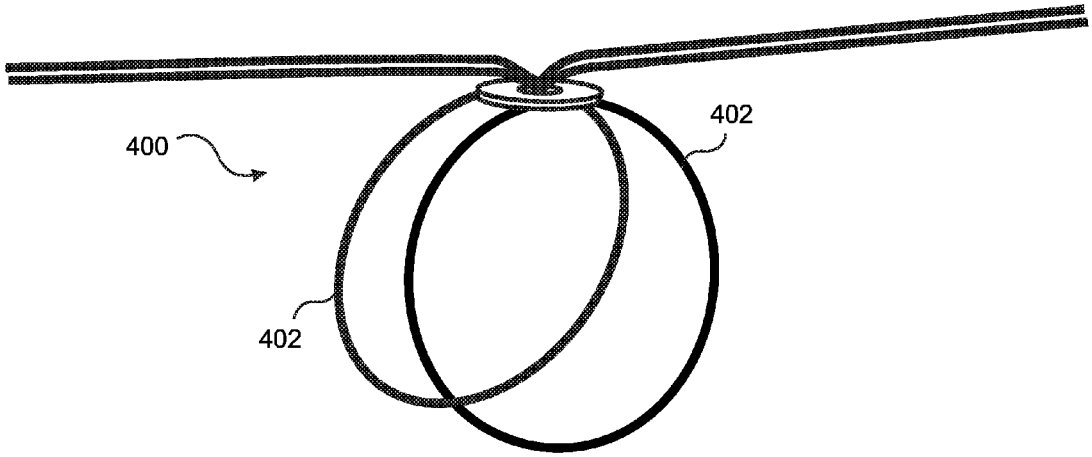
FIG. 5A is a close-up perspective view of the light-bulb-clip of FIG. 2 shown in relationship to a hose of spraying compound.
Figure 5A:
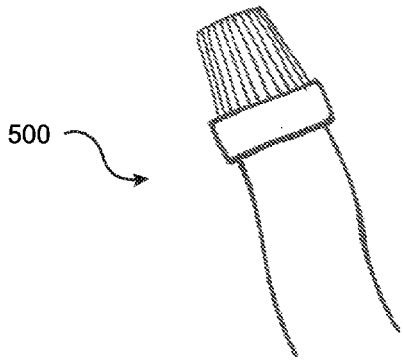
Figure 5B:
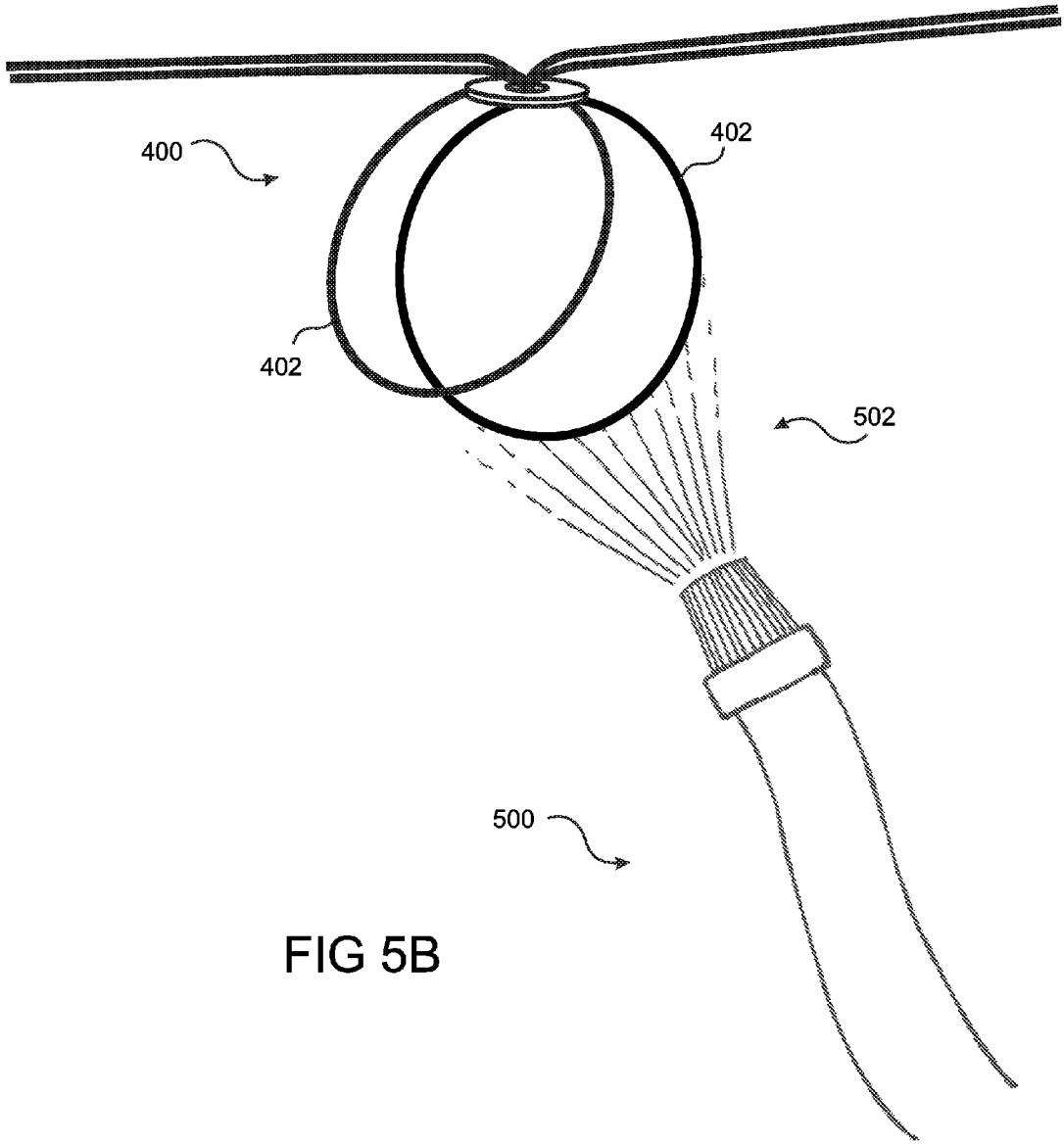
FIG. 5B is a close-up perspective view of the light-bulb-clip of FIG. 5A shown being sprayed by the hose of spraying compound.
Figure 5C:
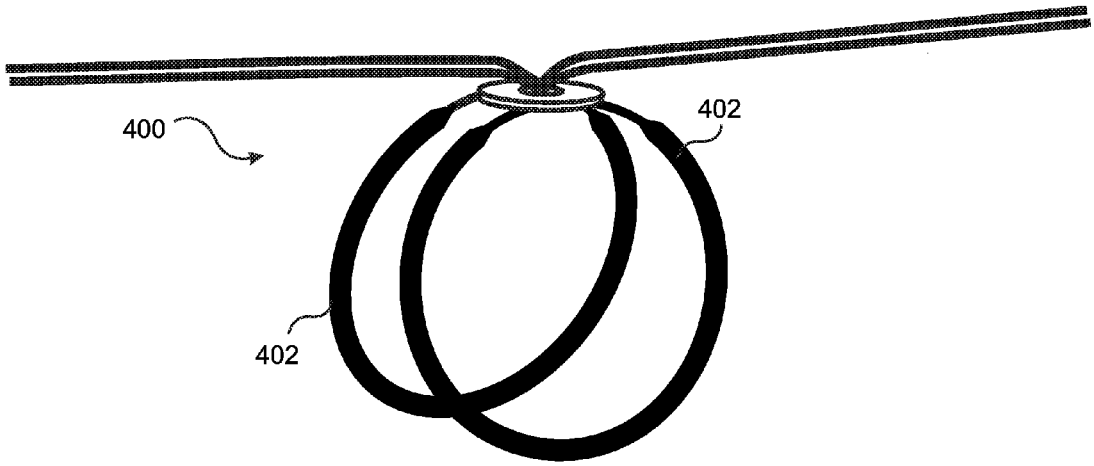
FIG. 5C is a close-up perspective view of the light bulb clip of FIG. 5B shown after being sprayed in the hose of spraying compound, with a coat of elastomeric material applied to the wire loops of the light-bulb-clip.
Figure 5C:
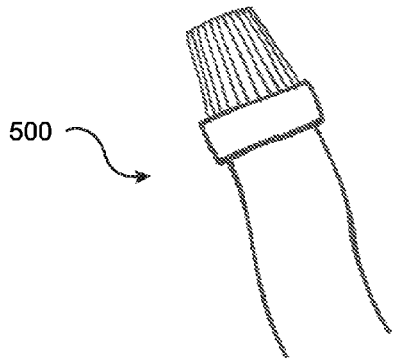

FIG. 5A shows the light-bulb-clip positioned near the hose and prepared to be sprayed, FIG. 5B shows the light-bulb-clip being sprayed by the hose, and FIG. 5C shows the result of the spraying, with the gripping portions of the wire loops of the light-bulb-clip now coated with a thick coating of the polymer compound.

Figure 6A:
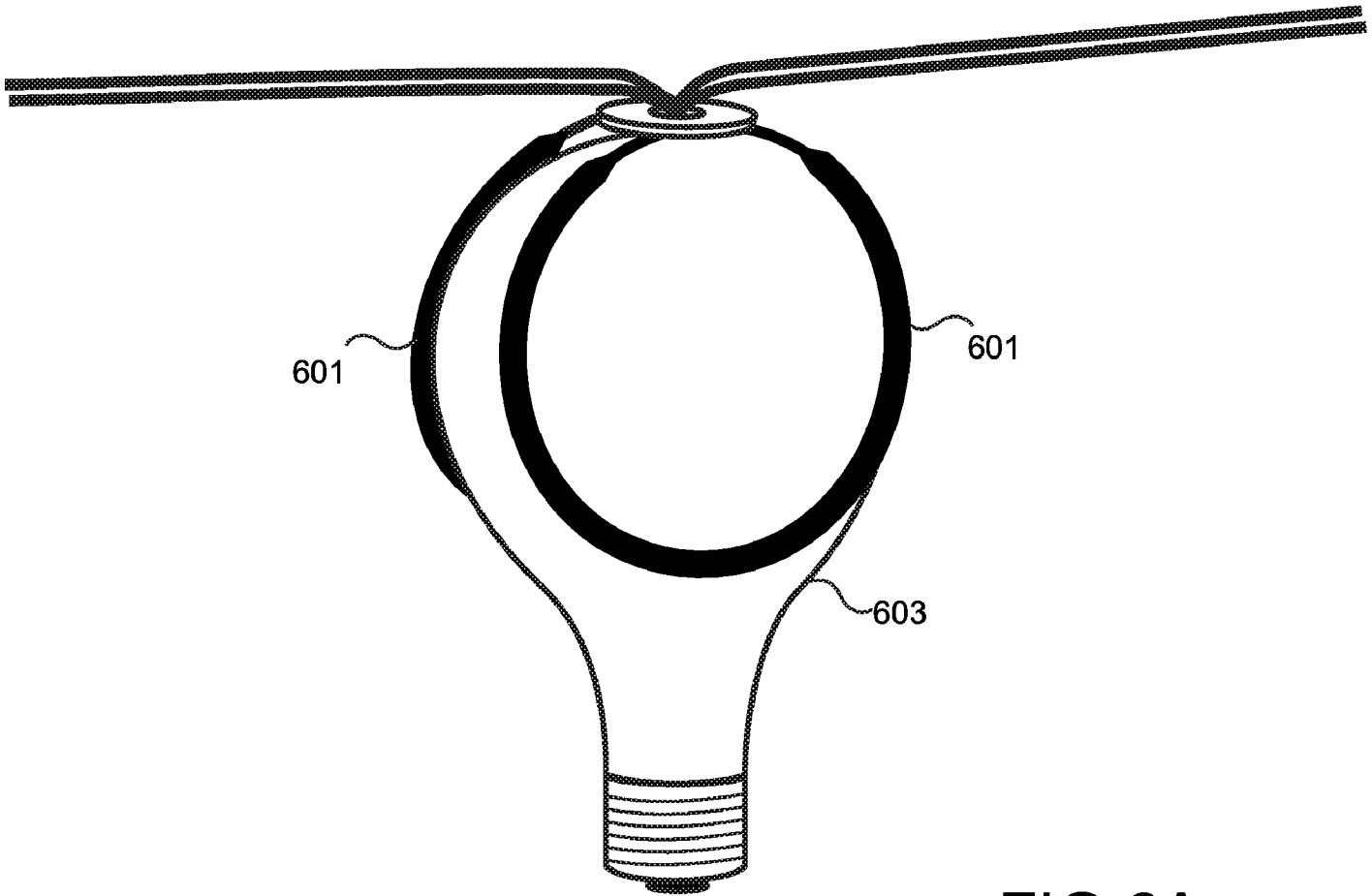
FIG. 6A is a close up view of the embodiment of FIG. 4C or FIG. 5C clipped to the standard incandescent light bulb of FIG. 3A.
Figure 6B:
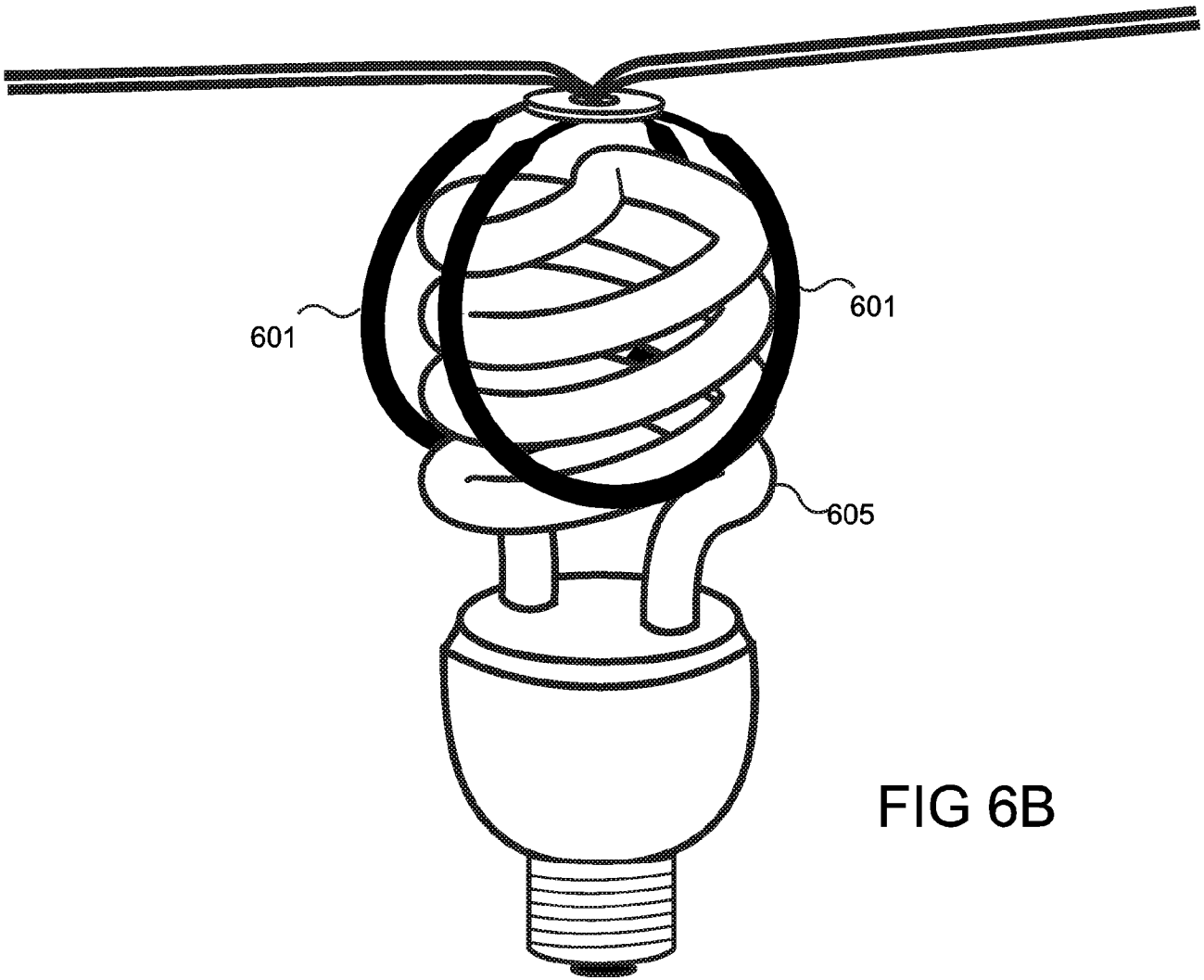
FIG. 6B is a close up view of the embodiment of FIG. 4C or FIG. 5C clipped to the CFL bulb of FIG. 3B.

FIG. 6A illustrates attachment of the retro-fit light-bulb-clip 601 of FIG. 4C or FIG. 5C to the standard incandescent light bulb 603 of FIG. 3A, and FIG. 6B illustrates attachment of the retro-fit light-bulb-clip 601 of FIG. 4C or FIG. 5C to the compact, replacement fluorescent light bulb 605 of FIG. 3B.

Other modifications and implementations will occur to those skilled in the art without departing from the spirit and the scope of the invention as claimed. Accordingly, the above description is not intended to limit the invention except as indicated in the following claims.

What is claimed is:

1. A method for increasing secureness of grip of a light-bulb-clip of a clip-on lampshade by enhancing the frictional properties of the light-bulb-clip, the light-bulb-clip being formed of shaped lengths of wire that frictionally grip an exterior surface of a light bulb by pressing gripping portions of the shaped lengths of wire against opposing exterior surfaces of the light bulb, the method comprising:

applying a coating of liquid polymer dipping compound to portions of the wire that are to function as the gripping portions of the light-bulb-clip, the polymer dipping compound being curable so as to form a cured layer suitable for increasing the frictional gripping capability of the gripping portions of the light bulb-clip; and curing the coating of liquid polymer dipping compound, so as to form a layer of cured polymer dipping compound on the portions of the wire that are to function as the gripping portions of the light bulb-clip, wherein the layer of cured polymer dipping compound is configured to contact the exterior surface of the light bulb.

2. The method of claim 1, wherein the portions of the wire that are to function as the gripping portions of the light-bulb-clip are abraded before the coating is applied.

3. The method of claim 1, wherein curing the coating of liquid polymer dipping compound includes at least one of:

heating the coating of liquid polymer dipping compound; and allowing the coating of liquid polymer compound to dry.

4. The method of claim 1, wherein applying the coating of liquid polymer dipping compound includes at least one of:

dipping the portions of the wire that are to function as the gripping portions of the light-bulb-clip into the liquid polymer dipping compound;

brushing the liquid polymer dipping compound onto the portions of the wire that are to function as the gripping portions of the light-bulb-clip; and spraying the liquid polymer dipping compound onto the portions of the wire that are to function as the gripping portions of the light-bulb-clip.

5. The method of claim 1, wherein the composition of the liquid polymer dipping compound includes at least one of:

PVC;
latex;
silicone;
rubber;
a rubber derivative;
an engineering polymer;
polyalkylene-terephthalate;
isophthalate; and
a copolyester.

6. The method of claim 1, wherein the liquid polymer dipping compound is made of at least one of heat-resistant elastomer, and heat-resistant silicone.

7. The method of claim 1, wherein the layer of cured polymer dipping compound is sufficiently heat-resistant to withstand heat from sustained direct contact with an operating incandescent light bulb.

8. A clip-on lampshade with enhanced light bulb gripping capability, the clip-on lampshade comprising:

a lampshade having a light bulb clip formed of shaped lengths of wire that frictionally grip an exterior surface of a light bulb pressing gripping portions of the shaped lengths of wire against the light bulb, the portions of wire that are to function as the gripping portions of the light-bulb-clip including a layer of cured polymer dipping compound that is able to increase the frictional gripping capability of the gripping portions of the light-bulb-clip, and the layer of cured polymer dipping compound having been formed on the gripping portions of the light-bulb-clip by abrading portions of the wire that are to function as the gripping portions of the light-bulb-clip by abrading portions of the wire that are to function as the gripping portions of the light-bulb-clip, applying a coating of liquid polymer dipping compound to the portions of the light-bulb-clip, and curing the coating of liquid polymer dipping compound, wherein the layer of cured liquid polymer dipping compound contacts the exterior surface of the light bulb.

9. The clip-on lampshade of claim 8, wherein curing the coating of liquid polymer dipping compound includes at least one of:

heating the coating of liquid polymer dipping compound; and allowing the coating of liquid compound to dry.

10. The clip-on lampshade of claim 8, wherein applying the coating of liquid polymer dipping compound includes at least one of:

dipping the portions of the wire that are to function as the gripping portions of the light-bulb-clip into the liquid polymer dipping compound;

brushing the liquid polymer dipping compound onto the portions of the wire that are to function as the gripping portions of the light-bulb-clip; and spraying the liquid polymer dipping compound onto the portions of the wire that are to function as the gripping portions of the light-bulb-clip.

11. The clip-on lampshade of claim 8, wherein the composition of the liquid polymer dipping compound includes at least one of:

PVC;
latex;
silicone;
rubber;
a rubber derivative;
an engineering polymer;
polyalkylene-terephthalate;
isophthalate; and
a copolyester.

12. The clip-on lampshade of claim 8, wherein the layer of cured polymer dipping compound is made of at least one of heat-resistant elastomer, and heat-resistant silicone.

13. The clip-on lampshade of claim 8, wherein the layer of cured polymer dipping compound is sufficiently heat resistant to withstand heat from sustained direct contact with an operating incandescent light bulb.

14. A finial clip-on lampshade adaptor with enhanced light bulb gripping capability; the finial clip-on lampshade adaptor comprising:

a light bulb clip formed of shaped lengths of wire that frictionally grip an exterior surface of a light bulb by pressing gripping portions of the shaped lengths of wire against the exterior surface of the light bulb, the gripping portions of the light-bulb clip including a layer of cured polymer dipping compound that is able to increase the frictional gripping capability of the gripping portions of the light-bulb-clip, and the layer of cured polymer compound having been formed on the gripping portions of the light-bulb clip by abrading portions of the wire that are to function as the gripping portions of the light-bulb-clip; applying a coating of liquid polymer dipping compound to the portions of the wire that are to function as the gripping portions of the light-bulb-clip, and curing the coating of liquid polymer dipping compounds, wherein the layer of cured polymer dipping compound is configured to contact the exterior surface of the light bulb.

15. The finial clip-on lampshade adaptor of claim 14, wherein curing the coating of liquid polymer dipping compound includes at least one of:

heating the coating of liquid polymer dipping compound; and allowing the coating of liquid polymer compound to dry.

16. The finial clip-on lampshade adaptor of claim 14, wherein applying the coating of liquid polymer dipping compound includes at least one of:

dipping the portions of the wire that are to function as the gripping portions of the light-bulb-clip into the liquid polymer dipping compound;

brushing the liquid polymer dipping compound onto the portions of the wire that are to function as the gripping portions of the light-bulb-clip; and spraying the liquid polymer dipping compound onto the portions of the wire that are to function as the gripping portions of the light-bulb-clip.

17. The finial clip-on lampshade adaptor of claim 14, wherein the composition of the liquid polymer dipping compound includes at least one of:

PVC;

latex;

silicone;

rubber;

a rubber derivative;

an engineering polymer;

polyalkylene-terephthalate;

isophthalate; and a copolyester.

18. The finial clip-on lampshade adaptor of claim 14, wherein the layer of cured polymer dipping compound is made of at least one of heat-resistant elastomer, and heat-resistant silicone.

19. The finial clip-on lampshade adaptor of claim 14, wherein the layer of cured polymer dipping compound is sufficiently heat resistant to withstand heat from sustained direct contact with an operating incandescent light bulb.

20. A method of forming a gripping layer on a light-bulb clip of a clip-on lampshade, the light-bulb clip having a first portion configured to contact an exterior surface of a light bulb and a second portion configured to support a lampshade, the method comprising:

abrading the first portion of the light-bulb clip;

applying a coating of liquid elastomeric compound on the first portion of the light-bulb clip, the elastomeric dipping compound being curable to form a cured layer; and curing the coating of the liquid elastomeric compound on the first portion of the light-bulb clip, wherein the cured layer is configured to contact the exterior surface of the light bulb.

21. The method of claim 20, wherein curing the coating of liquid elastomeric dipping compound includes at least one of:

heating the coating of liquid elastomeric dipping compound; and allowing the coating of liquid elastomeric compound to dry.

* * * * *